US010414608B2

(12) United States Patent
Wang et al.

(10) Patent No.: US 10,414,608 B2
(45) Date of Patent: Sep. 17, 2019

(54) ADJUSTING PRINT MEDIUM RETRIEVAL

(71) Applicant: Hewlett-Packard Development Company, L.P., Houston, TX (US)

(72) Inventors: Feng Wang, Shanghai (CN); Qiang Tang, Shanghai (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/704,422

(22) Filed: Sep. 14, 2017

(65) Prior Publication Data

US 2018/0118491 A1 May 3, 2018

(30) Foreign Application Priority Data

Oct. 28, 2016 (CN) ..... 2016 1 0965729

(51) Int. Cl.

| | |
|---|---|
| ***B65H 3/06*** | (2006.01) |
| ***B65H 7/20*** | (2006.01) |
| ***B65H 7/18*** | (2006.01) |
| ***B65H 5/06*** | (2006.01) |
| ***B65H 7/02*** | (2006.01) |

(52) U.S. Cl.

CPC ..... *B65H 7/18* (2013.01); *B65H 3/0669* (2013.01); *B65H 3/0684* (2013.01); *B65H 5/068* (2013.01); *B65H 7/02* (2013.01); *B65H 2511/20* (2013.01); *B65H 2513/50* (2013.01); *B65H 2515/32* (2013.01); *B65H 2553/51* (2013.01); *B65H 2555/24* (2013.01); *B65H 2601/255* (2013.01); *B65H 2801/12* (2013.01)

(58) Field of Classification Search

CPC ... B65H 7/06; B65H 7/14; B65H 7/18; B65H 7/20; B65H 2555/24; B65H 3/0684; B65H 3/0669

See application file for complete search history.

(56) References Cited

U.S. PATENT DOCUMENTS

| | | | | |
|---|---|---|---|---|
| 6,293,539 | B1 | 9/2001 | Fukatsu et al. | |
| 8,172,220 | B2 | 5/2012 | Foster et al. | |
| 8,746,676 | B2 | 6/2014 | Ota | |
| 8,931,878 | B2 * | 1/2015 | Sano | H02P 7/29 347/19 |
| 9,106,164 | B2 * | 8/2015 | Seki | H02P 8/14 |
| 9,302,866 | B1 | 4/2016 | Manor et al. | |
| 2015/0360892 | A1 * | 12/2015 | Yoshimizu | B65H 5/068 271/3.16 |

OTHER PUBLICATIONS

MACIMPULSE—"No More Paper Jams or Misfeeds!", <http://www.greendept.com/maximpulse/printer/ >, 2013, 4 pages.

* cited by examiner

*Primary Examiner* — Luis A Gonzalez

(74) *Attorney, Agent, or Firm* — Brooks Cameron & Huebsch PLLC

(57) ABSTRACT

Example implementations relate to adjusting print medium retrieval. For example, a system may include a printing device that may have a pick roller attached to a pick arm and a servomotor to apply torque to the pick roller. The system may further include a controller associated with the servomotor to determine a measured position of the servomotor relative to an intended position of the servomotor in a particular time frame during the print medium retrieval. The controller may further determine adjustment of the print medium retrieval based on comparison of a pulse width modulation (PWM) magnitude in adjacent time frames.

15 Claims, 5 Drawing Sheets

ADJUSTING PRINT MEDIUM RETRIEVAL

BACKGROUND

A pick roller of a printing device may be a cylindrical member, for instance, a rubber coated wheel. The pick roller may contribute to retrieval of a print medium, such as a sheet of paper, by engaging it and rotating to feed the print medium into a print zone of the printing device. A misfeed and/or a jam of the print medium may occur such that the pick roller is stressed during the print medium retrieval.

DETAILED DESCRIPTION

Figures 1A, 1B:
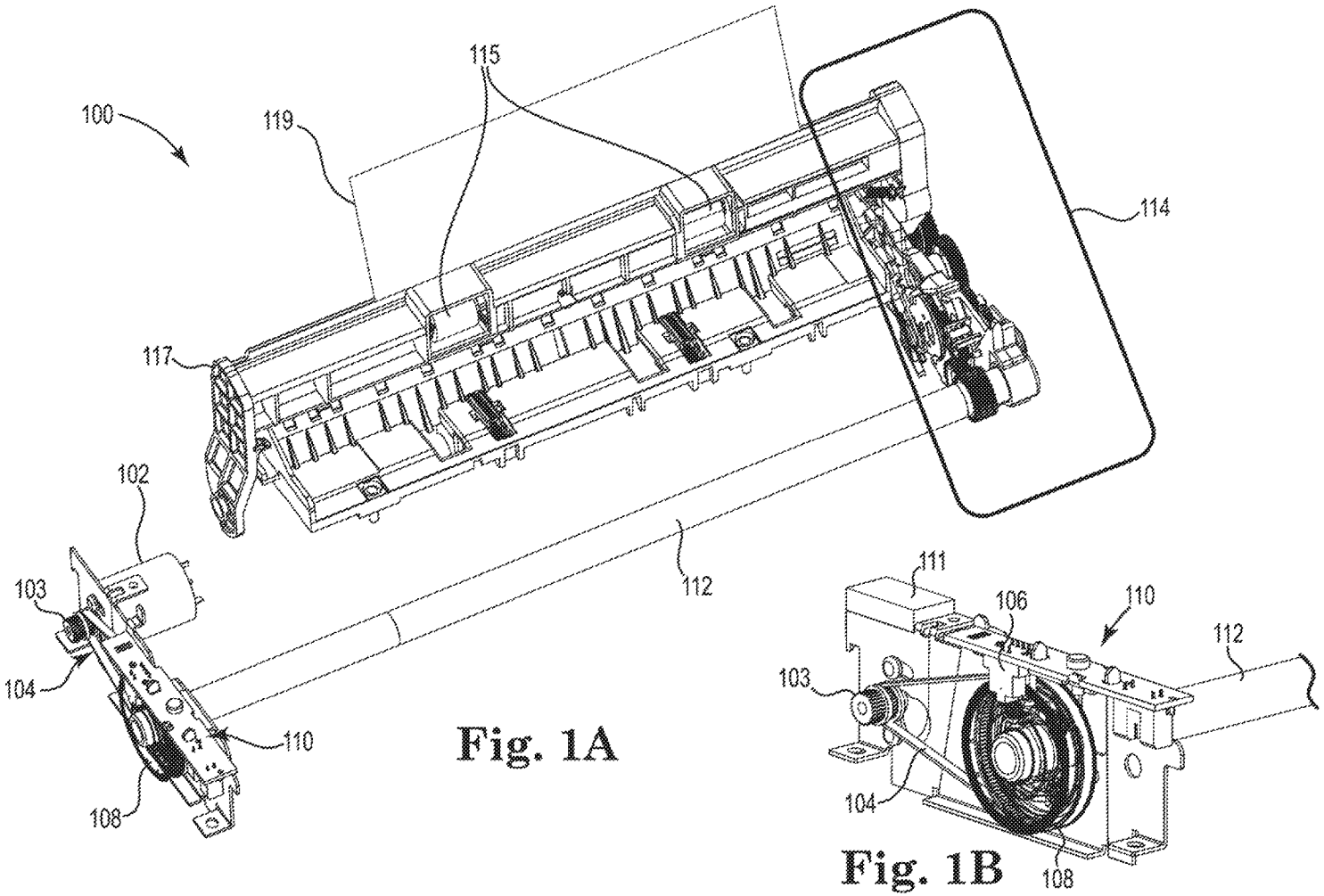
FIGS. 1A-1B illustrate perspective diagrams of an example print medium retrieval system for adjusting print medium retrieval, according to the present disclosure.

Example implementations described herein relate to adjusting print medium retrieval. For example, a system may include a printing device that may have a pick roller attached to a pick arm and a servomotor to apply torque to the pick roller. The system may further include an encoder disk, e.g., as shown at 108 in FIG. 1A, associated with the servomotor to enable determination, e.g., by a controller as shown at 110 in FIG. 1A, of a measured position of the servomotor relative to an intended position of the servomotor in a particular time frame during the print medium retrieval. The controller may further determine adjustment of the print medium retrieval based on comparison of a pulse width modulation (PWM) magnitude, associated with torque od the servomotor, in adjacent time frames.

A system for print medium retrieval is described herein, e.g., as shown at 100 and described in connection with FIG. 1, for use with a printing device of the system 100, e.g., in ink-jet and/or laser printers and copiers, among other implementations. Sheets of a print medium, e.g., as shown at 119 and described in connection with FIG. 1A, may be stacked on an input tray (not shown) associated with the printing device. The input tray may, in some examples, be in a fixed position such that a pick arm, e.g., as shown at 117 and described in connection with FIG. 1A, of the printing device may apply a determined amount of force, e.g., as applied through torque on the pick arm 117, to the print medium 119 via a rotating pick roller, e.g., pick rollers 115 described in connection with FIG. 1A. The input tray may be, in various examples, in a fixed position or may use a backup plate, e.g., urged upward by a spring member, that presses an uppermost sheet of the print medium 119 against the pick roller 115. As such, sheets of the print medium 119 may be engaged and retrieved one by one by the rotation of the pick roller 115 in an order beginning from an uppermost sheet.

Print medium retrieval systems, e.g., constructed as presented above, may be used for various purposes. Accordingly, these systems retrieve various types of print media 119 that may have a wide range of sizes, thicknesses, weights, compositions, friction factors, etc. Various types of the print media 119 may be worn and/or deformed during a print medium retrieval operation, e.g., when there is a misfeed and/or a jam of the print medium 119.

When retrieving stacked sheets of a print medium 119 using a frictional force, the greater the force applied to each sheet to press it against the pick roller 115, the larger the possibility that a plurality of sheets may be retrieved simultaneously. Therefore, a force to be applied via the pick roller 115 to each sheet of various types of print media 119 may be determined, e.g., a default force for each print medium 119 determined through testing, to reduce likelihood of a resultant misfeed and/or a jam. If the applied force is too small and/or a misfeed or a jam nonetheless occurs, slippage may occur between the uppermost sheet of the print medium 119 and the pick roller 115.

A pick roller 115 of the printing device may, in some examples, be a cylindrical member that has its outer surface coated with material selected to apply a frictional force, e.g., a rubber coated wheel, while being rotated in contact with a sheet of the print medium 119. The pick roller 115 may be the part of the print medium retrieval system 100 that directly interacts with the print medium 119 to effectuate retrieval. Slippage of the outer surface of the pick roller 115 on the print medium 119 may occur as a result of the misfeed and/or jam of the print medium 119 with the pick roller 115 nonetheless being driven, e.g., via a servomotor 102 described in connection with FIG. 1A, to maintain a nearly constant rotational speed, e.g., angular velocity. Hence, the pick roller 115 may be stressed, e.g., by increased friction inducing wear on the material that applies the frictional force. For example, the rubber coating may be worn away such that the pick roller 115 may be replaced. The increased friction also may damage the misfed and/or jammed print medium 119 and/or the increased friction may result in an increased stress, e.g., load, being applied to the servomotor 102, among other possible results.

Accordingly, the present disclosure describes adjusting print medium retrieval to reduce the stress applied, e.g., via the slippage, to the pick roller 115 and/or the servomotor 102 during print medium retrieval operations. For example, detection of such slippage, e.g., based on a comparison of PWM magnitude in adjacent time frames described herein, may result in adjustment of the print medium retrieval by, in some examples, interrupting and/or reinitiating the print medium retrieval operation and/or adjusting the angular velocity of the pick roller 115, among other possibilities.

FIGS. 1A-1B illustrate perspective diagrams of an example print medium retrieval system 100 for adjusting print medium retrieval, according to the present disclosure. As illustrated in FIG. 1A, the system 100 may include a servomotor 102 of the printing device utilized to drive 104, for example via a combination of a belt, gears, etc., e.g., an example of which is shown from a different perspective and in more detail at 104 in FIG. 1B , rotation of a pick roller 115. FIG. 1A shows two pick rollers 115 by way of example and not by way of limitation. For example, any number of pick rollers is included in the scope of the present disclosure.

As described herein, the pick roller 115 may be responsible for engaging a sheet of the print medium 119 and retrieving the sheet toward a print zone (not shown) of the printing device. In various examples, the drive 104 may operate through a feedroller assembly 112, e.g., a drive shaft, a transmission 114, and/or a pick roller shaft (not shown) supported by the pick arm 117 to apply torque to enable the rotation, e.g., angular velocity, of the pick roller 115. The transmission 114 may include various numbers of gears, cams, hydraulics, etc., arranged such that the angular velocity of the pick roller 115 may differ from a rate of rotation, e.g., revolutions (rotations) per minute (rpm), of the servomotor 102. In some examples, the transmission 114 also may apply torque on the pick arm 117 to rotate the pick arm, along with the pick roller 115, toward the print medium 119.

In various examples, the drive 104 may cause rotation of an encoder disk, e.g., as shown at 108 in FIG. 1A and from the different perspective in FIG. 1B. As such, the encoder disk 108 may be driven by the servomotor 102. The encoder disk 108 may be directly or indirectly connected to the feedroller assembly 112. The encoder disk 108 may include indicators, e.g., lines, dots, notches, etc., which may be spaced at regular intervals around the encoder disk 108. The indicators (not shown) of the encoder disk 108 may enable a sensor, e.g., as shown at 106 in FIG. 1B, to contribute to determination of a measured position and/or a speed of the encoder disk 108 to enable a corresponding determination of a measured position and/or a measured speed of the servomotor 102. The position and/or speed of the servomotor 102 may, for example, refer to how many revolutions or fractions of a revolution the servomotor 102 and/or an output shaft thereof, e.g., as shown at 103 in FIG. 1A and FIG. 1B, has completed in a particular time frame. A measured position and/or a measured speed of the servomotor 102 may be based on the detection by the sensor 106 of passage of a number of the indicators of the encoder disk 108, e.g., during a particular time frame.

The system 100 may include a controller, e.g., as shown at 110 in FIG. 1A and from the different perspective in FIG. 1B, associated with the servomotor 102. In various examples, the controller 110 may be or may include encoder circuitry. The controller 110 may be utilized to determine the measured position, e.g., as shown at 226 and described in connection with FIG. 2, of the servomotor 102 relative to an intended position, e.g., as shown at 225 and described in connection with FIG. 2, of the servomotor 102 in a particular time frame during print medium retrieval. The intended position 225 may be a number of revolutions or fractions of a revolution that the servomotor 102, an output shaft thereof 103, and/or the driven pick roller 115 is intended to complete, e.g., based on test measurements, for a particular type of print medium 119 at determined time frames when no slippage occurs. The controller 110 may be further utilized to determine adjustment, e.g., due to detected slippage, of the print medium retrieval based on comparison of a PWM magnitude in adjacent time frames, e.g., as described in connection with FIG. 3. For example, the magnitude of the PWM may be correlated with a position error 236 between the measured position 226 and the intended position 225 within the adjacent time frames, e.g., as described in connection with FIG. 2.

In some examples, the system 100 may include a main controller, e.g., as shown at 111 in FIG. 1B. The main controller 111 may be connected to and/or coordinate interaction between a power supply unit (not shown), the servomotor 102, the drive 104, the sensor 106, the encoder disk 108, and/or the controller 110, among other components of the system 100. In various examples, the main controller 111 and/or the controller 110 each may be a printed circuit assembly (PCA), e.g., where the controller 110 may be a sub-PCA of the main controller 111. As such, the controller 110 may be stated herein for clarity to be connected to, to make various determinations, and/or to control another component, e.g., the servomotor 102, the sensor 106, the pick roller 115, etc. However, in some examples, the controller 110 may be connected to, make the various determinations, and/or control the other component in combination with the main controller 111. The main controller 111 is shown also for clarity to be positioned adjacent the controller 110. However, the main controller 111 may be located elsewhere in the system 100, in various examples.

The controller 110 may, in some examples, be connected to the sensor 106 to determine the measured position 226 of the servomotor 102. As such, the controller 110 may determine the magnitude of the PWM in the adjacent time frames based on a position error, e.g., an absolute value of a difference, between the measured position 226, e.g., of the servomotor 102, relative to the intended position 225. As described herein, the magnitude of the PWM may correspond to an adjustment of torque of the servomotor 102. The torque of the servomotor 102 may be adjusted, e.g., increased, in order to compensate for an increased load resulting from an attempt to maintain a constant, e.g., default, angular velocity of the pick roller 115 despite the increased friction, e.g., load, due to slippage of the pick roller 115 on the print medium 119. In some examples, the controller 110 may control an angular velocity of the pick roller 115 during the print medium retrieval based on a comparison of a rate of change of the PWM to a threshold, e.g., as described in connection with FIG. 3, FIG. 4, and/or FIG. 5.

Figure 2:
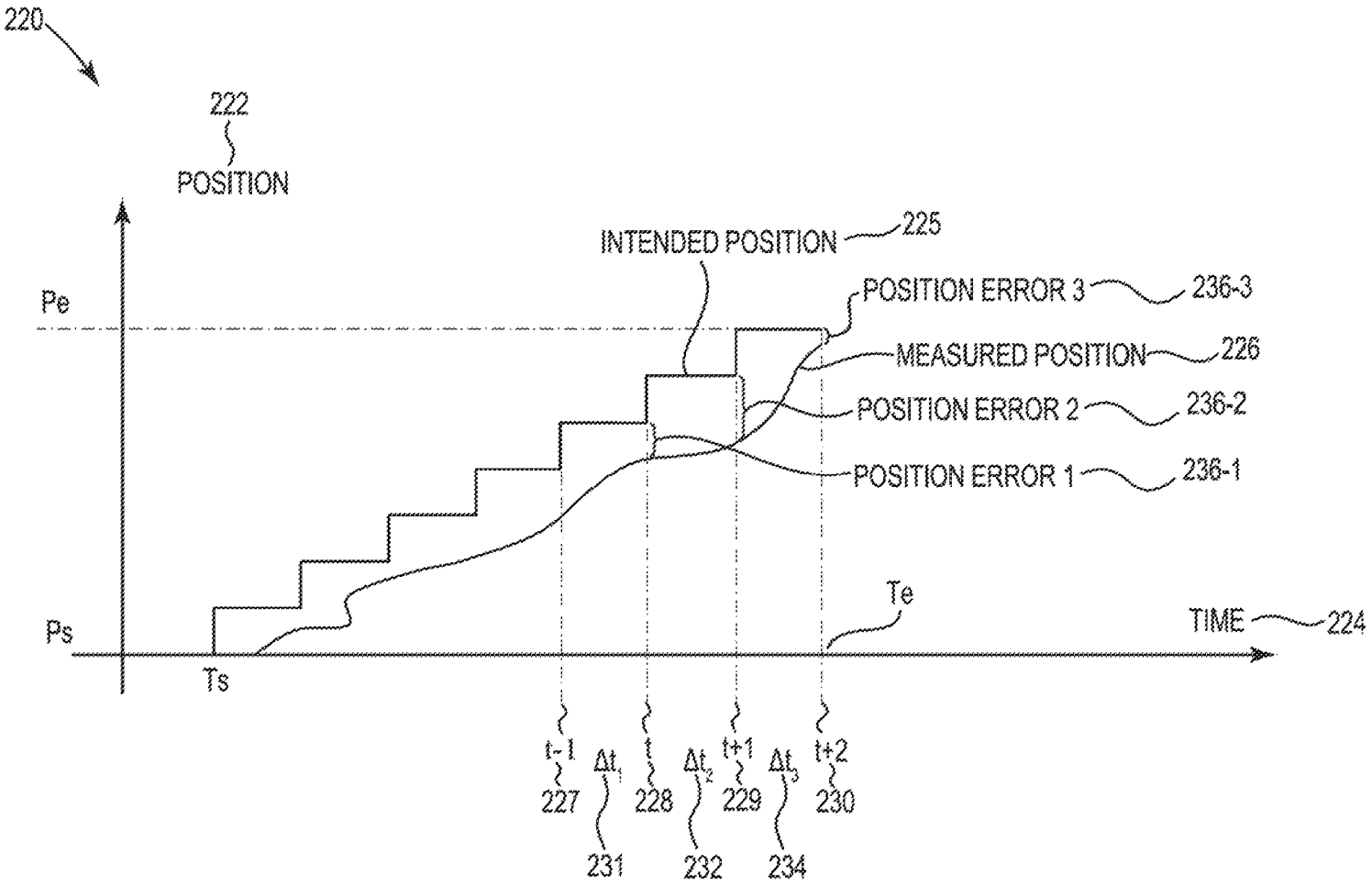
FIG. 2 illustrates an example of determination of a position error, according to the present disclosure.

FIG. 2 illustrates an example of determination of a position error, according to the present disclosure. FIG. 2 shows a graphical representation 220 of a position 222 of the servomotor 102 on the vertical axis from a start position (Ps) to an end position (Pe) as a function of time 224 passage on the horizontal axis from a start time (Ts) to an end time (Te).

Measurements, e.g., data values, relating to the position and/or speed of the servomotor 102 may be sent from the sensor 106 to the controller 110, e.g., the encoder circuitry, periodically to enable a measured position 226 of the servomotor 102 to be updated on a regular basis. For example, the measured position 226 of the servomotor 102 may be updated once every number of seconds, e.g., one second, two seconds, five seconds, etc., or fractions thereof, e.g., deciseconds, centiseconds, milliseconds, microseconds, etc.

To retrieve a sheet of print medium 119, e.g., paper, the servomotor 102 may be rotated from Ps to Pe with a speed (V for velocity). Based on these variables, a time T for complete retrieval of the print medium 119 may be calculated as: $T=(Pe-Ps)/V$. To obtain a more detailed representation of the retrieval, the complete retrieval may be separated into N smaller portions based on update times t, e.g., t−1 at 227, t at 228, t+1 at 229, and t+2 at 230, etc., as shown in FIG. 2. A delta time representing a respective time frame, e.g., $\Delta t_1$, $\Delta t_2$, and $\Delta t_3$, etc., may be used to represent the intended position 225 and/or the measured position 226 ($P_n$) at a determined time point ($t_n$) within the time frame $\Delta t_n$ as: $\Delta t=T/N$ and $P_n=[(Pe-Ps)N]*n$.

Time point to within the time frame $\Delta t_n$ may be determined consistently at a particular time point within each time frame $\Delta t_n$, e.g., update times t, t+1, and t+2, etc., at the end of each respective time frame $\Delta t_1$, $\Delta t_2$, and $\Delta t_3$, etc. At each time frame $\Delta t_n$ of the retrieval, based on a determined position error, e.g., position error 1 at 236-1, position error 2 at 236-2, and position error 3 at 236-3, etc., the PWM may vary, corresponding to a voltage applied to the servomotor 102. For example, when the measured position 226 is less than the intended position 225 within the time frame, as determined at the update time, the PWM (voltage) applied to the servomotor 102 may be increased an amount for the next Δt of the print medium retrieval. The increased torque may be intended to compensate for not achieving the intended position 225. When the measured position 226 is greater than the intended position 225 within the time frame, the PWM (voltage) applied to the servomotor 102 may be decreased an amount for the next Δt of retrieval to decrease the torque thereof to compensate for overshooting the intended position 225.

The time between updates may be referred to as a sample time Δt, e.g., the time frames $\Delta t_n$. For clarity, FIG. 2 shows three time frames at $\Delta t_1$, $\Delta t_2$, and $\Delta t_3$ although examples of graphical representations 220 may have an unlimited number of time frames. Time frame $\Delta t_1$ 231 is between update time t at 228 and a preceding update time t−1 at 227, time frame $\Delta t_2$ 232 is between update time t at 228 and a succeeding update time t+1 at 229, and time frame $\Delta t_3$ 234 is between update time t+1 at 229 and succeeding update time t+2 at 230. In some examples, update time t+2 at 230 may correspond to Te. As shown in the graphical representation 220 in FIG. 2, the measured positions 226 may have varying degrees of slope and/or curvature within each time frame, which may be sampled with finer granularity of update timing, in some examples.

The graphical representation 220 also shows the intended position 225 of the servomotor 102 at the respective update times. The intended positions 225 may be a number of revolutions or fractions of a revolution the servomotor 102 and/or the output shaft thereof 103 have been determined to complete when no slippage occurs, e.g., based on test measurements and stored in memory associated with the controller 110, for a particular type of print medium 119 at determined update times, corresponding to particular time frames. For example, time frame $\Delta t_1$ 231 is defined by update times t−1 at 227 and t at 228 and time frame $\Delta t_2$ 232 is defined by update times t at 228 and t+1 at 229.

Comparisons of an intended position 225 and a measured position 226 of the servomotor 102 may be made at any of the update times. The measured position 226 of the servomotor 102 may be different from the intended position 225 at any particular update time. For example, the positions may differ based on slippage of the pick roller 115 on the print medium 119 increasing friction, e.g., drag, that slows rotation, e.g., angular velocity, of the pick roller 115. The angular velocity of the pick roller 115 may correspond to the position and/or speed of the servomotor 102, e.g., by being mechanically connected via the transmission 114, feedroller assembly 112, drive 104, etc. The values of the measured positions 226 and the intended positions 225 each may have an associated time reference. For example, a value may be determined at a current update time t while a value from a preceding update time t−1 may be referenced to determine an average speed (velocity) of the servomotor 102 in that time frame, e.g., velocity (t)=[Position (t)−Position (t−1)]/Δt.

Consequently, the controller 110, e.g., in combination with the encoder disk 108 and the sensor 106, may determine an increased load on the servomotor 102 and increase the torque of the servomotor 102 to compensate for the reduced angular velocity of the pick roller 115 corresponding to the reduced speed of the servomotor 102. The increased torque may correspond to and/or be determined as a change, e.g., increase, in an associated PWM.

The graphical representation 220 also shows that a position error 236 may be determined as a difference, e.g., as determined by subtraction, between an intended position 225 and a measured position 226 at a particular update time and/or within a particular time frame. For example, position errors 236-1 and 236-2 may be determined at an end time point in each time frame, corresponding to update time t at 228 for time frame $\Delta t_1$ 231 and update time t+1 at 229 for time frame $\Delta t_2$ 232, among other possible time point positions in each time frame. The position errors 236 may correspond to an amount of slippage in a particular time frame and may be compared to preceding time frames and succeeding time frames. Such comparisons may be used to determine whether compensatory adjustments to servomotor 102 torque have reduced or stopped slippage, e.g., to maintain a constant position error between adjacent time frames or to bring the measured position 226 of the servomotor 102 closer to the intended position 225 and thereby reduce the position error. The comparisons also may be used to determine whether the compensatory adjustments to the servomotor 102 torque have been ineffective in overcoming slippage, e.g., by the measured position 226 of the servomotor 102 being farther away from the intended position 225 and the position error increasing in a succeeding time frame.

For example, position error 1, as shown at 236-1, may be determined for update time t at 228. Depending on determined print medium retrieval operation parameters, e.g., accuracy, calibration, etc., position error 1 at 236-1 may or not be indicative of slippage. When a determination is made that the position error 1 at 236-1 does indicate slippage, compensatory adjustment may be made to the torque of the servomotor 102. Following passage of time frame $\Delta t_2$ 232, position error 2 at 236-2 may be determined for update time t at 229. The magnitude of the position error 2 at 236-2 is greater than the magnitude of the position error 1 at 236-1 for the preceding time frame. As such, a determination may be made that compensatory adjustment, e.g., increase, of the torque of the servomotor 102 is not overcoming the slippage and that alternative adjustments to the print retrieval operation, as described herein, may be more effective in overcoming the slippage and the consequent stress on the pick roller 115. Alternatively or in addition, a decision may be made, e.g., by the controller 110, to initiate an alternative adjustment to the print retrieval operation based on a rate of change, e.g., increasing slope, among other possibilities, of the difference between the intended position 225 and the measured position 226 between adjacent time frames, or within a time frame, meeting or exceeding a threshold. In contrast, the position error 3 at 236-3 for update time t+2 at 230 is less than the position error 2 at 236-2, which may indicate that compensatory adjustment of torque of the servomotor 102 is overcoming the slippage.

The magnitude of the position error at one update time may be used to determine by how much to increase the torque of the servomotor 102 and the efficacy of overcoming the slippage may be determined at the adjacent, e.g., next, update time. Determining at the adjacent update time, or after a series of update times, that adjustment to the torque, e.g., as indicated by an increase in PWM, has been ineffective in overcoming the slippage may indicate that alternative adjustments to the print retrieval operation, as described herein, may be more effective.

When slippage occurs, a position error 236 for a particular time frame, e.g., position error 236-2 for time frame $\Delta t_2$ 232, may be larger than a position error 236 for a preceding time frame, e.g., position error 236-1 for time frame $\Delta t_1$ 231. The PWM (voltage) may be increased in the next time frame, e.g., $\Delta t_3$ 234, of the print medium retrieval. Such a series of adjustments to the torque of the servomotor 102 may continue until a PWM associated with the adjustment, e.g., increase, of torque meets or exceeds a threshold to indicate the slippage, e.g., as shown at 349 and described in connection with FIG. 3.

Figure 3:
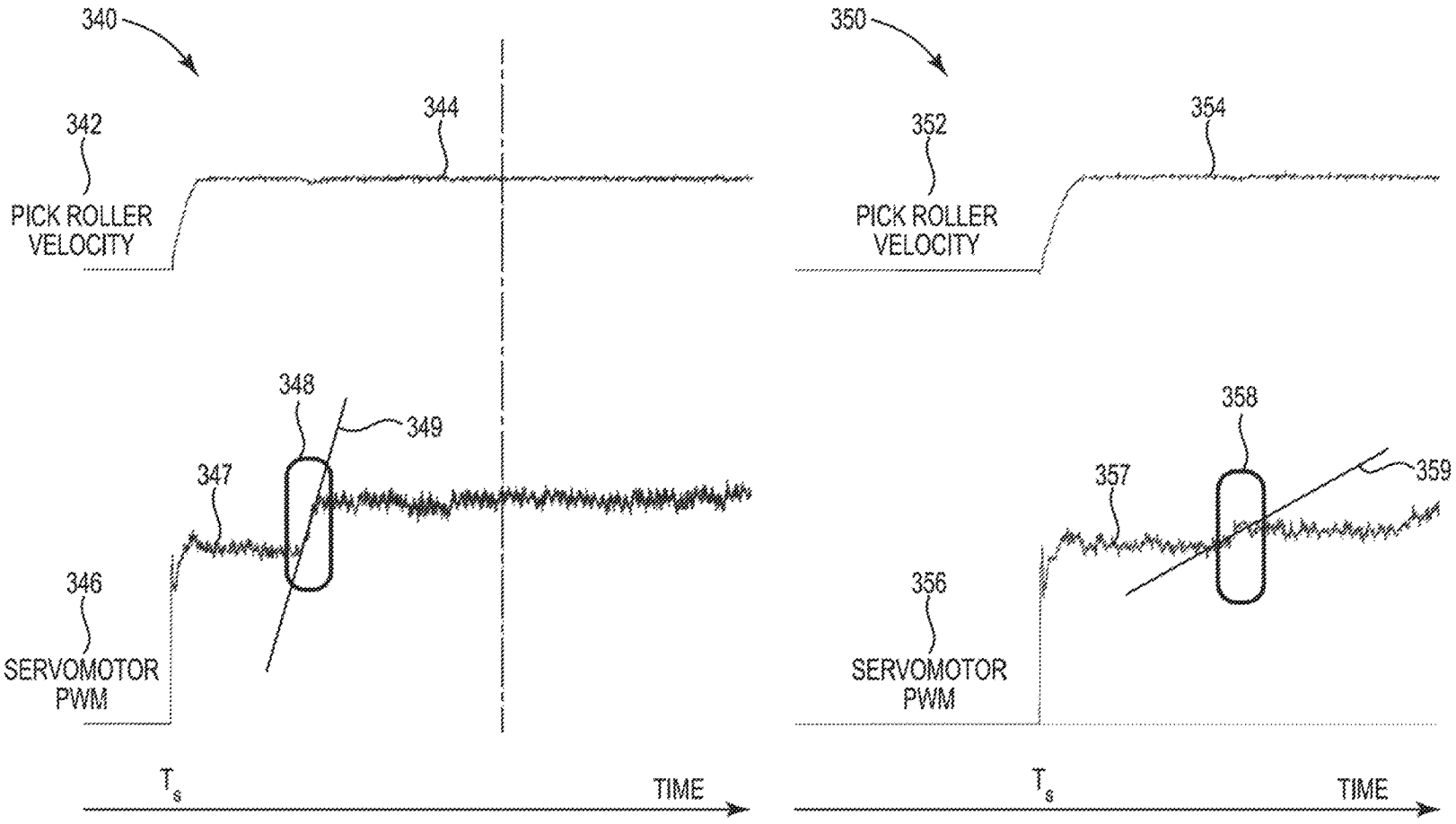
FIG. 3 illustrates an example of determination of slippage of a pick roller during print medium retrieval, according to the present disclosure.

FIG. 3 illustrates an example of determination of slippage of a pick roller 115 during print medium retrieval, according to the present disclosure. FIG. 3 illustrates a graphical representation 340 of slippage of a pick roller 115 during print medium retrieval in comparison to a graphical representation 350 of a pick roller 115 not slipping during print medium retrieval.

Graphical representation 340 shows an increase in angular velocity 342 of a pick roller 115 and a corresponding increase in PWM 346, indicating torque of the servomotor 102, for a print medium retrieval operation at a start time (Ts). As shown in 340, the angular velocity 344 of the pick roller 115 may remain relatively constant, e.g., at a default angular velocity, during the print medium retrieval operation even though slippage of the pick roller 115 occurs on the print medium 119. The angular velocity 344 of the pick roller 115 may remain relatively constant based on torque of the servomotor 102 being adjusted to compensate for position errors 236, described in connection with FIG. 2, even though slippage occurs.

During print medium retrieval in graphical representation 340, the PWM 346 associated with the torque of the servomotor 102 (servomotor PWM) may remain relatively constant 347, e.g., reflecting relatively constant torque of the servomotor 102, in the beginning of print medium retrieval. However, during slippage 348, the PWM 346 may undergo a rapid change, e.g., based on the time scale. A magnitude of the change and/or a rate of the change may be used, e.g., by the controller 110, to determine an alternative, as described herein, to adjusting torque of the servomotor 102 to overcoming the slippage 348. The magnitude of the change, e.g., to determine the alternative, may be based on a threshold value of the change from the relatively constant PWM. The rate of the change may be based on a threshold value of a slope 349 of the change, e.g., as determined by a magnitude of the change in a particular time frame. Other determinants may be used to determine whether an alternative and/or which alternative is to be used instead of adjusting torque of the servomotor 102 to overcoming the slippage 348. For example, the controller 110 may execute proportional control, integral control, and/or derivative control (PID) instructions to contribute to such a determination.

Graphical representation 350 also shows an increase in angular velocity 352 of the pick roller 115 and a corresponding increase in PWM 356 for a print medium retrieval operation at Ts. As shown in 350, the angular velocity 354 of the pick roller 115 may remain relatively constant, e.g., at the default angular velocity, during the print medium retrieval operation because no slippage of the pick roller 115 on the print medium 119 occurs. During print medium retrieval in graphical representation 350, the servomotor PWM 356 may remain relatively constant 357, e.g., reflecting relatively constant torque of the servomotor 102, throughout print medium retrieval. In some examples, a fluctuation 358 in the PWM may occur without slippage or with minor. However, such a fluctuation 358 may be distinguished from the slippage 348 of the PWM shown in graphical representation 340 by the magnitude of the change and/or the rate of the change not being as large. For example, the slope 359 in the fluctuation 358 may be less than the slope 348 in the slippage 348, e.g., thereby not meeting a threshold value.

Figure 4:
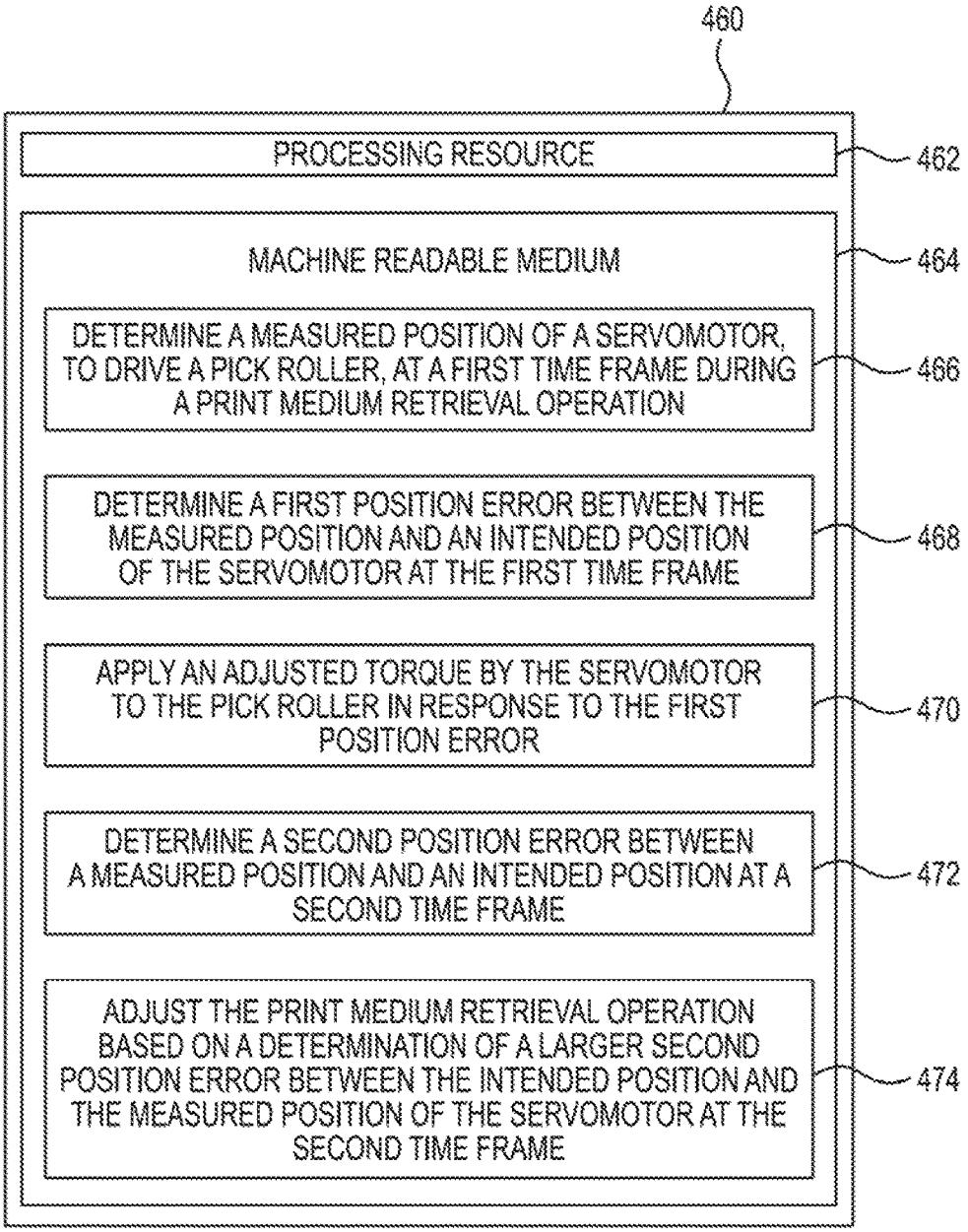
FIG. 4 illustrates a diagram of an example system that includes a non-transitory machine readable medium and a processing resource for adjusting print medium retrieval, according to the present disclosure.

FIG. 4 illustrates a diagram of an example system 460 that includes a non-transitory MRM 464 and a processing resource 462, e.g., a number of processors, for adjusting print medium retrieval, according to the present disclosure. For example, the system 460 may be an implementation of the example systems of FIGS. 1-3 or the example method of FIG. 5.

The processing resource 462 may include a number of central processing units (CPUs), microprocessors, and/or other hardware devices suitable for retrieval and execution of instructions stored in the MRM 464. As an alternative or in addition to retrieving and executing instructions, the processing resource 462 may include electronic circuits including a number of electronic components for performing the functionality of one or more of the instructions in the MRM 464. With respect to the executable instruction representations described and shown herein, e.g., boxes in FIG. 4, it is to be understood that part or all of the executable instructions and/or electronic circuits included within one box may, in alternate embodiments, be included in a different box shown in the figures or in a different box not shown.

The processing resource 462 may execute instructions stored on the MRM 464. The MRM 464 may be any type of volatile or non-volatile memory or storage. The MRM 464 may be any electronic, magnetic, optical, or other physical storage device that stores executable instructions. Thus, MRM 464 may be, for example, Random Access Memory (RAM), an Electrically-Erasable Programmable Read-Only Memory (EEPROM), Flash memory, Read-Only Memory (ROM), a hard disk, a storage drive, an optical disc, and the like, or a combination thereof. MRM 464 may be disposed within system 460, as shown in FIG. 4. In this situation, the executable instructions may be "installed" on the system 460. Additionally or alternatively, the MRM 464 may be a portable, external or remote storage medium, for example, that allows system 460 to download the instructions from the portable/external/remote storage medium. In this situation, the executable instructions may be part of an "installation package".

The MRM 464 may store instructions executable by the processing resource 462. For example, the MRM 464 may store instructions 466 to direct a printing device to determine a measured position, e.g., as shown at 226 and described in connection with FIG. 2, of a servomotor 102, to drive 104 a pick roller 115, at a first time frame, e.g., at $\Delta t_1$ 231 in FIG. 2, during a print medium retrieval operation. The MRM 464 may store instructions 468 to determine a first position error, e.g., position error 1 at 236-1, between the measured position 226 and an intended position 225 of the servomotor 102 at the first time frame 231. The MRM 464 may store instructions 470 to apply an adjusted torque by the servomotor 102 to the pick roller 115 in response to the first position error 236-1. The MRM 464 may store instructions 472 to determine a second position error, e.g., position error 2 at 236-2, between a measured position 226 and an intended position 225 of the servomotor 102 at a second time frame, e.g., at $\Delta t_2$ 232. The MRM 464 also may store instructions 474 to adjust the print medium retrieval operation, as described herein, based on a determination of a larger second position error 236-2, relative to the first position error 236-1, between the intended position 225 and the measured position 226 of the servomotor 102 at the second time frame $\Delta t_2$ 232.

In some examples, the MRM 464 may store instructions to determine a first PWM, e.g., as shown at 347 and described in connection with FIG. 3, corresponding to a first torque applied by the servomotor 102 in the first time frame 231, and determine a second PWM, e.g., as shown at 348 and described in connection with FIG. 3, corresponding to a second torque applied by the servomotor 102 in the second time frame 232 having the larger second position error, e.g., position error 236-2. The MRM 464 may store instructions to adjust the print medium retrieval operation based on determination of a larger second PWM relative to the first PWM, e.g., a magnitude of PWM shown at 348 compared to a magnitude of PWM shown at 347 in FIG. 3. A magnitude of a position error in a particular time frame may correspond to a magnitude of a PWM for the particular time frame. For example, the magnitude of position error 236-1 in FIG. 2 may correspond, e.g., be proportional, to the magnitude of the PWM 358 in graphical representation 350 and the larger magnitude of position error 236-2 may correspond, e.g., be proportional, to the larger magnitude of the PWM 348 in graphical representation 340 indicating slippage.

In various examples, the MRM 464 may store instructions to interrupt, e.g., at least temporarily stop, the print medium retrieval operation based on the determination of the larger second position error 236-2 and/or the larger PWM 348. As described herein, the determination of whether to interrupt the print medium retrieval operation, e.g., rather than continue adjustment of the torque of the servomotor 102 and/or to reduce angular velocity of the pick roller 115, may be based on comparison of the larger second position error 236-2 and/or PWM 348 to a threshold. The threshold may, in some examples, be a particular magnitude of the position error 236-2 in time frame $\Delta t_2$ 232 and/or a particular magnitude of the PWM shown at 348. In some examples, the threshold may be a rate of change of the position errors and/or the PWMs in adjacent time frames, e.g., as shown at 349 and 359 and described in connection with FIG. 3.

The MRM 464 may, in various examples, store instructions to interrupt the print medium retrieval operation based on determination of an increased rate of change of a third position error, e.g., position error 3 at 236-3, at a third time frame, e.g., at $\Delta t_3$ 234, relative to the second position error, e.g., 236-2 in time frame $\Delta t_2$ 232. For example, the magnitude and/or rate of change in the third time frame relative to the second time frame may determine whether adjustment of torque of the servomotor 102 has reduced the position error and/or slippage, indicated by an associated PWM, or whether slippage continues or is increased. The MRM 464 may store instructions to reinitiate, after a determined period of time, the interrupted print medium retrieval operation. In some examples, the determined period of time may be a predetermined period of time, e.g., based on test measurements with various print media 119, stored in memory associated with the processing resource 462.

Figure 5:
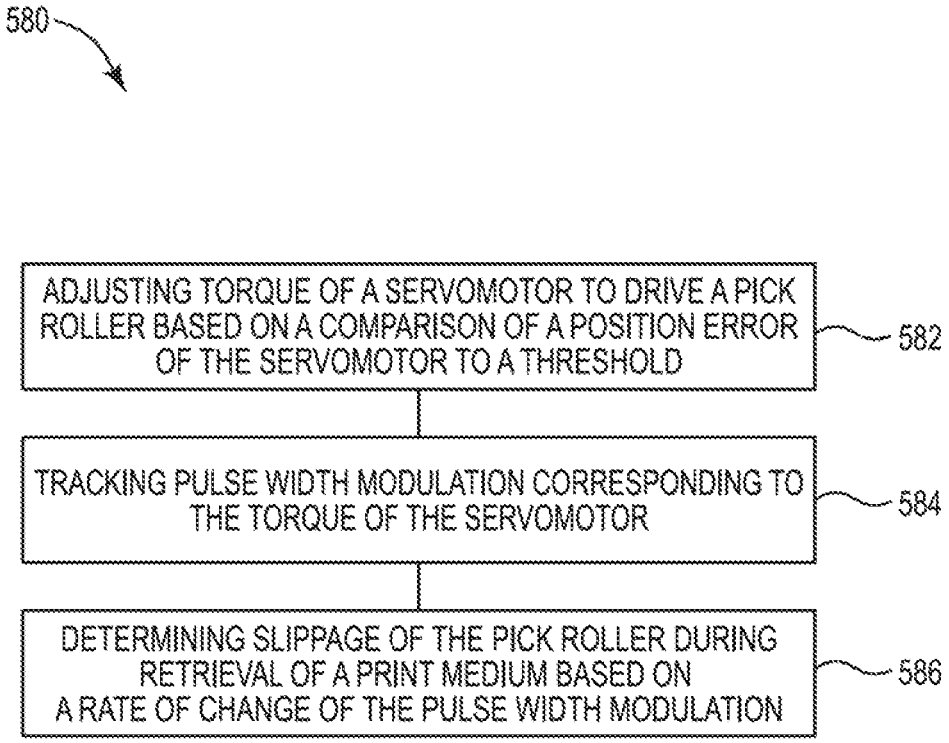
FIG. 5 illustrates an example method for adjusting print medium retrieval, according to the present disclosure.

FIG. 5 illustrates an example method 580 for adjusting print medium retrieval, according to the present disclosure. For example, the method 580 may be an implementation of the example systems of FIGS. 1-4.

At 582, the method 580 includes adjusting a torque of a servomotor 102 to drive 104 a pick roller 115 based on a comparison of a position error of the servomotor 102 to a threshold, e.g., as described in connection with FIG. 2 and/or FIG. 3. At 584, the method 580 includes tracking PWM corresponding to the torque of the servomotor 102, e.g., as described in connection with FIG. 3. At 586, the method 580 includes determining a slippage, e.g., as shown at 348 and described in connection with FIG. 3, of the pick roller 115 during retrieval of a print medium 119 based on a rate of change of the PWM, e.g., as shown at 349 and described in connection with FIG. 3. The rate of change of the PWM that indicates slippage, and consequent adjustment of the print medium retrieval operation, may be based upon comparison of the rate of change to a threshold. For example, a rate of change of the PWM, e.g., as indicated by a best fit slope 349, may meet or exceed a threshold to indicate slippage. In contrast, a rate of change of the PWM, e.g., as indicated by a best fit slope 359, may not meet the threshold to indicate slippage. The best fit slope may be determined by the system 100, e.g., controller 110, using, for example, a least square method and/or linear regression, among other possibilities.

In some examples, the method 580 may include determining the position error based on a difference in a particular time frame between a measured position 226 of the servomotor 102 relative to an intended position 225 of the servomotor 102, e.g., as described in connection with FIG. 2. A comparison of position errors in adjacent time frames, determined by respective differences in the particular time frame and the measured position 226 in adjacent the time frames, may be performed, e.g., by the controller 110, which may be or may include the encoder circuitry, shown in and described in connection with FIG. 1.

As a consequence, in some examples, the rotation of the pick roller 115 may be interrupted. The rotation of the pick roller 115 may be interrupted, e.g., at least temporarily stopped, based on a comparison of a rate of change of the PWM to a threshold, e.g., as described in connection with FIG. 3. The magnitude of the PWM in each time frame may, for example, be determined by the position error between the measured position 226 and the intended position 225 within the adjacent time frames, e.g., at an end time point in each time frame, among other possible time point positions in each time frame. Alternatively or in addition, the method may include reducing an angular velocity, e.g. a rate of change of angular displacement measured in w or revolutions per minute (rpm), among other units, of the pick roller 115 based on the comparison of the rate of change of the PWM to a threshold.

In embodiments in which there is a choice between interrupting the revolution and reducing the angular velocity of the pick roller 115, the threshold for interruption of the rotation may be different from the threshold for reducing the angular velocity of the pick roller 115. For example, a higher rate of change of the PWM, e.g., a higher threshold, may be used to determine that the print medium retrieval operation is to be interrupted by interrupting the rotation of the pick roller 115. The rotation of the pick roller 115 may be interrupted by, for example, stopping rotation of the servomotor 102 driving the pick roller 115 and/or by disengaging the drive in the transmission 114, among other possibilities. A lower rate of change of the PWM, e.g., a lower threshold, may be used to determine that the print medium retrieval operation is to be altered by reducing the angular velocity of the pick roller 115, e.g., by reducing a rate of rotation, e.g., rpm, of the servomotor 102 or altering a drive ratio in the transmission 114.

After a determined period of time, e.g., as predetermined and/or directed by the controller 110, the interrupted print medium retrieval operation may be reinitiated a number of times. For example, the print medium retrieval operation may be reinitiated in a range of from 2 to 6 times, e.g., each reinitiation preceded by an interruption, before stopping the print medium retrieval operation. Stopping the print medium retrieval operation may be accompanied by a particular warning light on the printing device, a particular error message, e.g., indicating a misfeed and/or jam of the print medium 119, or a service call.

Reinitiation of the print medium retrieval operation may include resuming rotation of the pick roller 115 at the same angular velocity, e.g., a default angular velocity, at which the print roller was rotating prior to the interruption. In some examples, reinitiation of the print medium retrieval operation may include resuming rotation of the pick roller 115 at a different angular velocity. For example, rotation of the pick roller 115 may be reinitiated at a lower angular velocity or a greater angular velocity relative to the angular velocity at which the print roller was rotating prior to the interruption. The default, lower, and/or greater angular velocities may be determined by testing, e.g., in controlled and/or measured tests, of the efficacy of various angular velocities on various sizes, thicknesses, weights, compositions, etc., of print media 119. The tests may be performed to determine the efficacy of print medium retrieval using the various angular velocities during normal print medium retrieval, e.g., to determine the default angular velocity of the pick roller 115, versus using the various angular velocities during various situations, e.g., misfeeds, jams, etc., that may result in stress on the pick roller 115 and/or on the servomotor 102, e.g., resulting from slippage.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can be inclusive of one or a plurality of such elements and/or features, as appropriate to the context.

What is claimed:

1. A system, comprising:
a printing device, comprising:
a pick roller attached to a pick arm;
a servomotor to apply torque to the pick roller; and
a controller associated with the servomotor to:
determine a measured position of the servomotor relative to an intended position of the servomotor in a first time frame during print medium retrieval, wherein print medium retrieval comprises application of torque by the servomotor to the pick roller to retrieve a print medium from an input tray associated with the printing device;
determine adjustment of the print medium retrieval based on comparison of a pulse width modulation (PWM) magnitude between the first time frame and a second time frame; and
apply an adjusted torque based on the comparison of the PWM magnitude between the first time frame and the second time frame.

2. The system of claim 1, wherein the PWM magnitude is to be determined based on a position error between the measured position and the intended position within the first time frame and the second time frame.

3. The system of claim 1, wherein the controller:
is connected to a sensor to determine the measured position of the servomotor; and
is to determine the PWM magnitude in the first time frame and the second time frame based on a position error between the measured position of the servomotor relative to the intended position; and
wherein the PWM magnitude corresponds to an adjustment of torque of the servomotor.

4. The system of claim 1, wherein the controller is to:
control an angular velocity of the pick roller during the print medium retrieval based on a comparison of a rate of change of the PWM to a threshold.

5. The system of claim 1, further comprising:
an encoder disk driven by the servomotor; and
wherein the encoder disk comprises indicators to enable a sensor to contribute to determination of a position of the encoder disk to enable corresponding determination of the measured position of the servomotor.

6. A non-transitory machine readable medium storing instruction executable by a processing resource to:
direct a printing device to:
determine a measured position of a servomotor, to drive a pick roller, at a first time frame during a print medium retrieval operation, wherein print medium retrieval operation comprises application of torque by the servomotor to the pick roller to retrieve a print medium from an input tray associated with the printing device;
determine a first position error between the measured position and an intended position of the servomotor at the first time frame;
apply an adjusted torque by the servomotor to the pick roller in response to the first position error;
determine a second position error between a measured position and an intended position of the servomotor at a second time frame; and
adjust the print medium retrieval operation based on a determination of a larger second position error, relative to the first position error, between the intended position and the measured position of the servomotor at the second time frame.

7. The medium of claim 6, including instructions to:
determine a first pulse width modulation (PWM) corresponding to a first torque to be applied by the servomotor in the first time frame;
determine a second PWM corresponding to a second torque to be applied by the servomotor in the second time frame having the larger second position error;
adjust the print medium retrieval operation based on determination of a larger second PWM relative to the first PWM; and
wherein a magnitude of a position error in a particular time frame corresponds to a magnitude of a PWM for the particular time frame.

8. The medium of claim 6, including instructions to:
interrupt the print medium retrieval operation based on the determination of the larger second position error.

9. The medium of claim 8, including instructions to:
reinitiate after a determined period of time the print medium retrieval operation interrupted based on the determination of the larger second position error.

10. The medium of claim 6, including instructions to:
determine whether to interrupt the print medium retrieval operation based on comparison of the larger second position error to a threshold.

11. The medium of claim 6, including instructions to:

interrupt the print medium retrieval operation based on determination of an increased rate of change of a third position error at a third time frame relative to the second position error.

12. A method, comprising:

adjusting, during a print medium retrieval, a torque of a servomotor to drive a pick roller based on a comparison of a first position error of the servomotor to a threshold at a first time frame, wherein print medium retrieval comprises application of torque by the servomotor to the pick roller to retrieve a print medium from an input tray associated with a printing device;

tracking a pulse width modulation (PWM) corresponding to the torque of the servomotor;

determining a slippage of the pick roller during retrieval of the print medium based on a rate of change of the PWM; and adjusting the print medium retrieval based on a determination of a second position error, relative to the first position error, between an intended position and a measured position of the servomotor at a second time frame.

13. The method of claim 12, further comprising:

determining the second position error based on a difference in a particular time frame between a measured position of the servomotor relative to an intended position of the servomotor.

14. The method of claim 12, further comprising:

interrupting a rotation of the pick roller based on a comparison of a rate of change of the PWM to a threshold.

15. The method of claim 12, further comprising:

reducing an angular velocity of the pick roller based on a comparison of a rate of change of the PWM to a threshold.

* * * * *